US005222798A

United States Patent [19]

Adams

[11] Patent Number: 5,222,798

[45] Date of Patent: Jun. 29, 1993

[54] LIGHT GRENADE

[76] Inventor: Craig Adams, 1150 S. Juniper St., Escondido, Calif. 92025

[21] Appl. No.: 812,437

[22] Filed: Dec. 20, 1991

[51] Int. Cl.[5] ..... F41F 1/34

[52] U.S. Cl. ..... 362/110; 362/186; 102/355

[58] Field of Search ..... 102/355, 361; 340/815.15, 815.18; 362/109, 157, 183, 186, 205, 253, 110

[56] References Cited

U.S. PATENT DOCUMENTS 4,976,201 12/1990 Hamilton ..... 102/355 X 4,985,813 1/1991 Putman ..... 340/815.18 X

*Primary Examiner*—Stephen F. Husar

*Attorney, Agent, or Firm*—William C. Fuess

[57] ABSTRACT

A self contained, self-powered, bright, typically visible, light source in a strong case having a transparent dome is thrown or fired into position by police as a non-injurious agent of coercive intervention. Light is emitted after a predetermined delay, typically ten seconds, from a unidirectional manual actuation, typically by act of pulling an insulating plastic strip from between electrical contacts within the case. Once activated, the light source may not be readily deactivated, and will shine sufficiently brightly so as to be temporarily blinding to the direct view of any human who is close enough to the light source so as to touch it. A spent light source may be discarded but is commonly recycled by being recharged.

19 Claims, 2 Drawing Sheets

FIG. 3
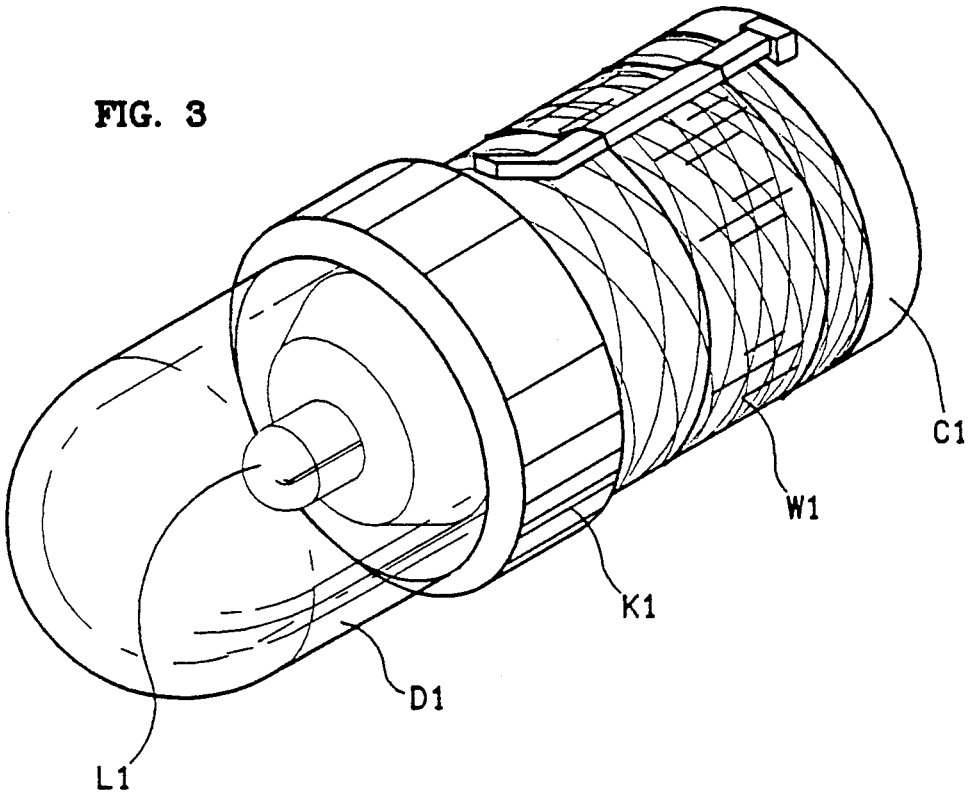
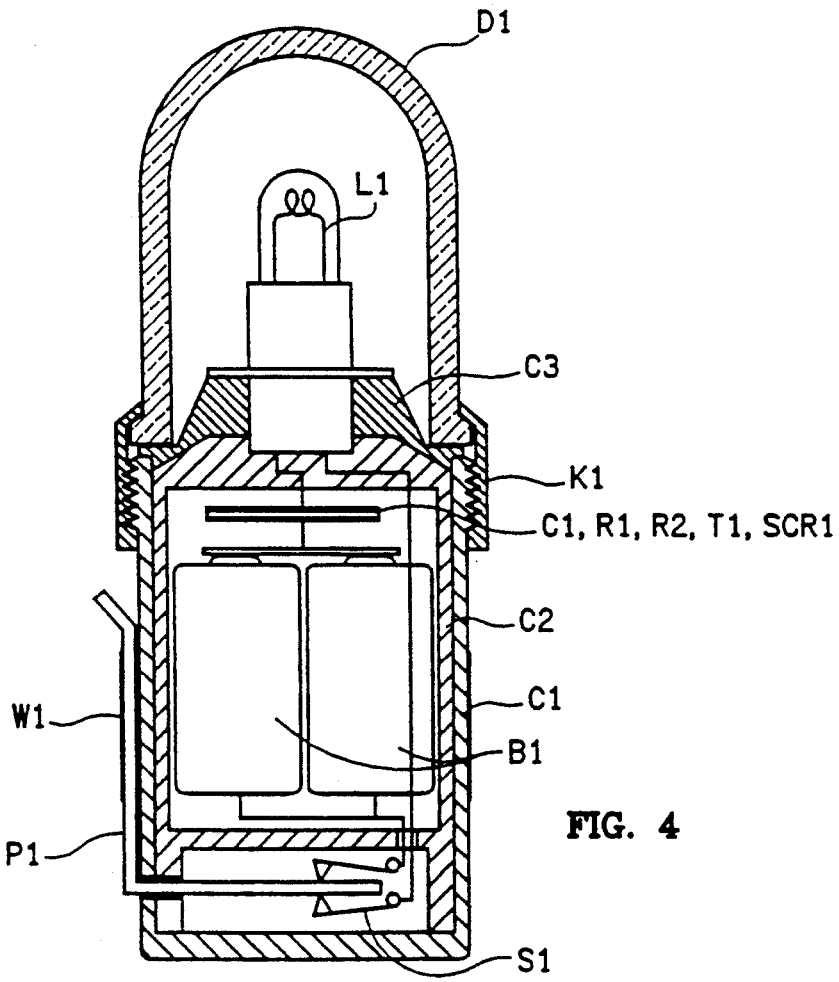
FIG. 4

LIGHT GRENADE

BACKGROUND OF THE INVENTION

1. Field of the Invention

The present invention generally concerns non-injurious agents of coercive intervention usable by law enforcement and like personnel to manipulate the environment, including human actors within the environment.

The present invention particularly concerns a ruggedized portable bright light sources usable by policemen and firemen and the like to temporarily illuminate hazardous dark areas without substantial risk to themselves or persons present within the dark areas.

2. Background of the Invention

Criminals have always sought the obscuring cloak of darkness, and criminal activity peaks at night. Many forms of criminal activity that are currently, circa 1991, prevalent in the United States of America involve trade in illegal drugs, or criminals who have ingested illegal drugs. Because of the illegality of selling or consuming illegal drugs, both sales and consumption are commonly conducted during the hours of darkness, and in locations that are poorly illuminated.

Still other criminal activities such as theft are common at night, and are commonly conducted with no or minimal illumination. Indeed, in the common law burglary was defined as unauthorized entrance into a dwelling house at night with the intention of thievery—thereby recognizing the special severity, and the difficulty of preventing or interdicting, crime during the hours of darkness.

Meanwhile, in the U.S. the propensity for violent criminal response to any intervention by law enforcement personnel is currently very high. Criminals are not only willing to resist apprehension by use of deadly force, but are often extremely well armed with weapons of new types that were previously seldom previously encountered by the police. These weapons include semi-automatic sidearms and para-military weapons that hold, and that may rapidly fire, a considerable number, typically in excess of a dozen, large caliber rounds of considerable destructive force.

According to the concealment of darkness in which criminal activities frequently take place, the propensity of criminals to resist the discovery of these activities by the police, and the considerable armaments that criminals possess and seem willing to use in resisting discovery of their illegal activities, normal nocturnal criminal investigative activities have become increasingly hazardous to the police. One simple, and time-honored, scenario of police investigation during the hours of darkness, or in darkened locations, is to shine a flashlight beam upon a suspected scene of criminal activity and/or suspected criminals. In the past a mere inspection by the police infrequently precipitated hostilities, including gunfire. If gunfire did occur it was frequently ineffective, being only a few rounds fired from small caliber weapons.

Unfortunately, modern weapons in the hands of criminals who have scant regard for either human life or police power are serving to make this investigative scenario very risky to the police. The police now realize that even the most causal inspection by flashlight beam of a darkened area may be met with a lethal fusillade of bullets. The fear of personal injury makes the job of the police more difficult, and may even have a deleterious effect on the curiosity, and frequent observations, that are fundamental to investigative police work.

According to this state of affairs, certain technologies that serve to protect the police during their investigations of suspected criminal activities in dark areas are both useful, and widely accepted. One such technology is body armor, including the bulletproof vest. Another such technology is the investigative robot. The robot may be typically sent in harm's way under remote control without jeopardizing human life. Unfortunately, robots are expensive, time-consuming and cumbersome to deploy. Moreover, they generally lack the mobility and flexibility that is required in most investigative situations.

The most common tool—the flashlight—that the police use to illuminate dark areas has considerably improved during recent decades. Modern police flashlight cases are strong, and may be suitably used as clubs. The emitted light is considerably brighter, and is often longer-lasting, than was previously the case. The advent of quartz-halogen light sources has particularly benefitted the police flashlight, which is, in certain cases, desired to emit a very bright, nearly blinding, light beam.

An unavoidable problem with the existing police flashlight, even one emitting a very bright light, is that the policeman holding the flashlight must identify his location. There is usually a time delay between a policeman's energization of his/her flashlight and his/her visual fixation of a person or persons within the flashlight's illuminating beam. There is a further time delay while the policeman, who may be attempting to aim his/her flashlight with a one hand while protecting himself/herself with a loaded weapon in the other hand, interprets the illuminated scene. During these time delays, which may be only momentary, the policeman is in jeopardy of being shot without warning by the party(ies) illuminated, or even by other parties who are still concealed by darkness Because of these obvious risks, and tensions, the police investigation of a scene of criminal activity, and the apprehension of a criminal suspect(s) under conditions of darkness, is an exciting moment much favored by dramatists. Unfortunately, the real-world police who all too commonly encounter this situation are not substantially comforted, nor rendered more secure, by the universal understanding, in which they share, that the literal shining of light on criminal activity is, in America circa 1991, a very hazardous activity.

SUMMARY OF THE INVENTION

The present invention contemplates a portable source of bright visible light usable as a non-injurious agent of coercive intervention by law enforcement and public safety personnel to manipulate the environment, including human actors within the environment, without appreciable risk of injury to either the personnel or to the actors.

The present invention particularly contemplates a self-contained self-powered source of visible light that is thrown or launched, normally while it is itself still dark, into regions requiring illumination. After being so placed in position the light source automatically commences to provide light illumination.

The provided illumination is typically over a circular angle of three hundred and sixty degrees (360°), and over a solid angle of nearly four steradians. The illumination is typically sufficiently bright so as to be temporarily blinding to the direct view of any human that is proximately located, and is certainly blinding to any human who is close enough to the light source so as to touch it. The temporary blinding will persist for at least the duration of any interval that the light source is directly viewed, and normally also for several seconds afterwards.

The light source in accordance with the present invention is preferably electrical. It is accordingly in somewhat the form of a very bright, a particularly configured, and a particularly controlled, flashlight. The light source is typically contained within an armored case. This armored case is sufficiently strong so as to substantially prevent that a human might, by manual force alone and without use of tools, disable the blindingly bright light emission of the light source.

The intended use, and operation, of the light source is analogous to a grenade, only without any explosion or resulting injury(ies) to persons or property. When a policemen, firemen of like person desires to illuminate a potentially hazardous location, he or she then arms the light source, normally much in the manner of a grenade by the pulling of a "pin". Then, during a predetermined delay time interval, the person arming the light source throws or otherwise ejects it into a suspicious darkened area.

Persons within the area of illumination are often quite surprised when light output from the light source commences. If they draw near to the light emission in order to investigate then one purpose of the light source is met. Alternatively, if they shy away from the emitting light source then their intent to remain concealed is made manifest, and another purpose of the light source is met.

Unauthorized persons are unlikely to be able to disable—forcibly or otherwise—the energized, emitting, light source. However, if the policeman or other party deploying the light source so desires, then he/she may usually disable an energized source by use of a tool. Conversely, it is the normal, and expected, usage and practice to either (i) return the light source to a depot (e.g., a police station) for recharging, or (ii) abandon it on site as an expendable item.

In one embodiment of the invention a bright electrical light source within a strong case is combined with a manually-activated unidirectional switch. The light source is typically, but not necessarily, a visible light source, and is nominally a 55 watt quartz halogen bulb. The bulb is under a hardened dome, typically made from Lexan ® plastic (registered trademark of General Electric Company) or Pyrex ® glass (registered trademark of Corning Glass Company). The dome provides 360 degrees circular angle, and nearly four steradians solid angle, of light emission.

The unidirectional switch is preferably actuated by a distinct and unambiguous motion, normally a pulling motion serving to permanently pull an inexpensive piece of flexible plastic from an aperture within the case. The unidirectional (pull) switch is ineffectual to permit that, once turned on, the light source may thereafter manually be turned off. Once turned on, the light source will thereafter emit its bright visible light to the capacity of its self-contained power. Once turned on, the light source is protected by the strong case, and also by the unidirectional action of its switch, from being turned off.

In operational use as a "light grenade" such a device may be thrown or otherwise injected into a dark area while still in a darkened state. The encased bright light source is combined with a delay turn-on circuit. In response to a manual actuation the circuit turns on the visible light source only after a lapse of a predetermined interval of time, normally about ten (10) seconds.

Accordingly, after a predetermined period of time, the "light grenade" will "explode" in order to provide bright illumination to a surrounding area. The "light grenade" cannot be turned off, nor manually disabled, by criminals or other persons who do not desire its illuminating light output.

In operational use as a "light grenade" a man, such as a policeman, first manually actuates the delay turn-on circuit, and may then places the encased bright light source in a desired location during the predetermined interval of time before the light is emitted. In this manner the case and its contained light source may be relatively safely moved into position by law enforcement personnel without requiring such personnel to illuminate themselves, thereby possibly exposing themselves to hazards such as gunfire.

After such a delay as permits the "light grenade" to be positioned, it will commence to illuminate the surrounding area, including any human actors therein, with a bright light.

In still other embodiments, the "light grenade" in accordance with the present invention may emit infrared light. It may be fired into position in the manner of the launch of a conventional explosive grenade by use of a high power rifle. It may be tailored to emit blinking light, or light of a predetermined frequency. It may be physically and electrically adapted for use in firefighting in darkened buildings, including as a beacon or semaphore signal.

These and other aspects and attributes of the present invention will become increasingly clear upon reference to the following drawings and accompanying specification.

BRIEF DESCRIPTION OF THE DRAWINGS

FIG. 3 is a diagrammatic view showing the preferred embodiment of a light grenade in accordance with the present invention for which the schematic was shown in FIG. 2.

FIG. 4 is a plan view, partially in cut-away cross-section, showing the preferred embodiment of a light grenade in accordance with the present invention previously seen in FIGS. 2 and 3.

DESCRIPTION OF THE PREFERRED EMBODIMENT

Figure 1:
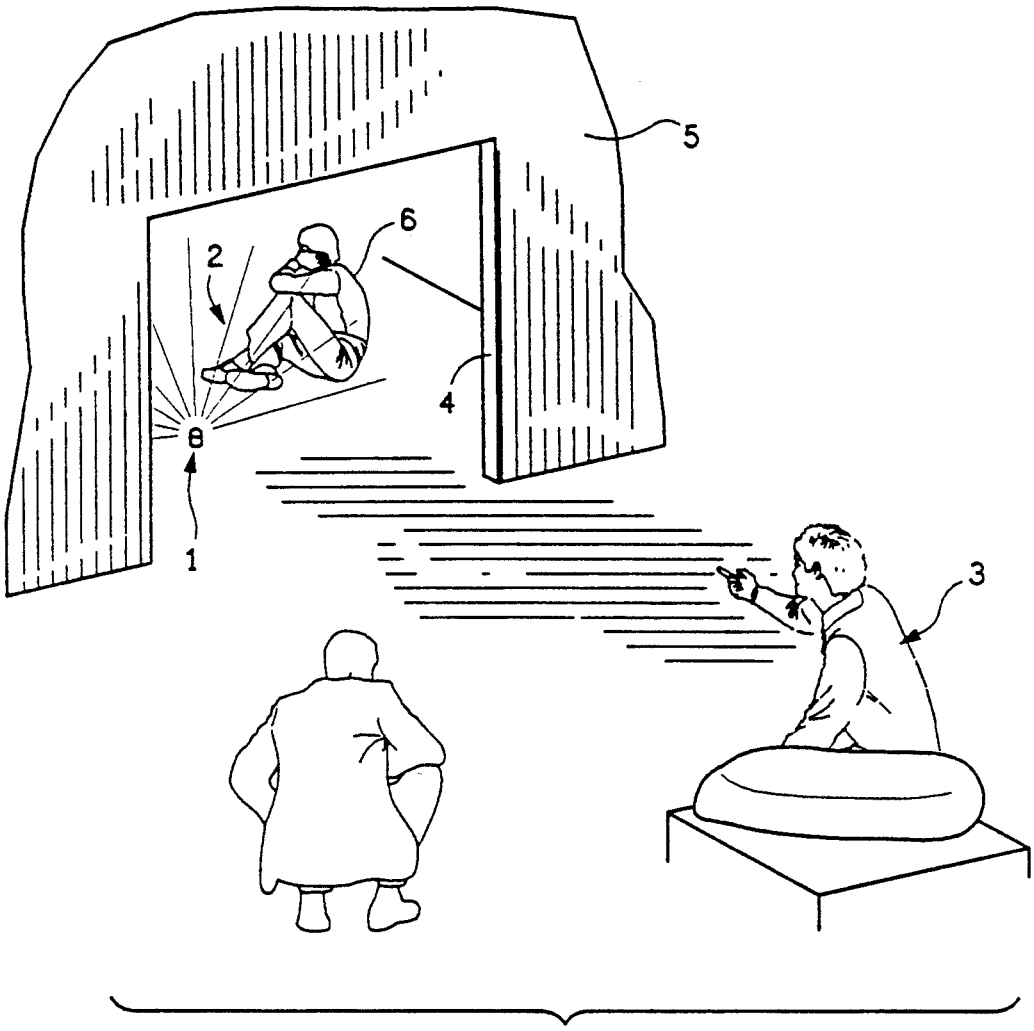
FIG. 1 is a pictorial diagram showing one possible scenario of use of the light grenade in accordance with the present invention.
Figure 2:
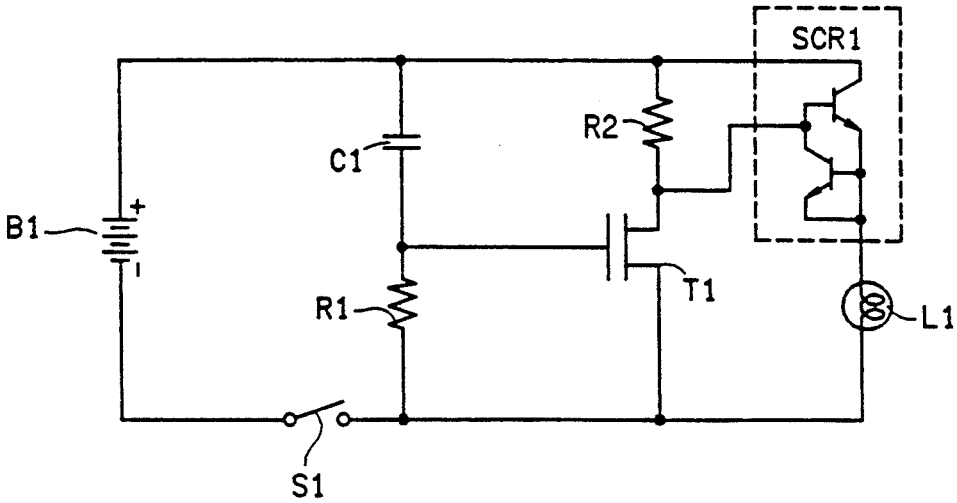
FIG. 2 is a schematic diagram of the preferred embodiment of a light grenade in accordance with the present invention.

A preferred embodiment of the present invention of a "light grenade" is illustrated in operational use in FIG. 1, in schematic diagram in FIG. 2, in diagrammatic view in FIG. 3, and in partially cut-away cross-sectional plan view in FIG. 4.

A typical scenario of use of the light grenade 1 is shown in FIG. 1. The scenario has evolved to the point where the light grenade 1 is both (i) operationally deployed, and (ii) illuminated. As will be explained, these events do not normally happen at the same time.

In the illustrated scenario the person 2 has thrown the light grenade, possibly by an underhand toss, through the portal 4 of building 5. As will be shown, the ruggedized construction of the light grenade effectively precludes that it may be damaged by throwing, howsoever far or hard. The light grenade 1 fits the hand, and can normally be thrown equally as easily, and as hard and as far, as a baseball.

A suspect 6 detected within the interior darkened area of building 5 is unlikely to be permanently damaged even if accidentally hit by a thrown light grenade. This is desirable because the person throwing the grenade does not desire to injure innocent, but unseen, parties within the darkened area. Most commonly the light grenade 1 simply rolls or bounces to a stop within the interior darkened area of building 5. In its preferred embodiment, the light grenade will illuminate, producing a bright, typically white, light output 11, after lapse of a predetermined time interval from its previous actuation.

The illumination typically proves blinding to suspect 6 should he/she attempt to directly view the illuminated light grenade 1. Even if the light grenade 1 is grabbed by suspect 6, it cannot be shut off, nor, realistically, can it be disabled. The suspect 6 may (i) cover the emitting light grenade, or (ii) throw it again, including in a direction back towards the originator 3. However, the suspect 6 is fully illuminated while so engaging. Even if the light grenade is tossed back to its originator(s), it will not harm them. Normally the light grenade is simply left in its light-emitting condition until its power is exhausted. If desired, it may be recovered by its originator and recycled in use.

A schematic diagram of the preferred embodiment of a light grenade 1 in accordance with the present invention is shown in FIG. 2. A battery B1 is typically constructed from a number, nominally four, electrically series-connected dry cell batteries, preferably 3 volt d.c. lithium batteries. The nominal preferred voltage of battery B1 is thus 12 v.d.c.

Upon manual actuation of the switch S1 by mechanisms to be explained in conjunction with FIGS. 3 and 4, a current from the battery B1 flows through resistor R1 having a preferred value of 580 kilohms and accumulates as a voltage charge on capacitor C1 having a preferred value of 100 microfarads. When sufficient charge has accumulated on the capacitor C1 so as to produced a predetermined, threshold, voltage level then the field effect transistor T1, preferably type IRF 511, will be biased to conduction.

The conduction of transistor T1, which draws only a modest 120 milliamperes current through a resister R2 having a typical value of 100 ohms, provides a control input voltage essentially equal to ground (0 v.d.c.) to the silicon controlled rectifier SCR 1. The SCR 1 is preferably Radio Shack part number 276 1067, or equivalent. The SCR 1 will, during such times as it is so controlled, conduct a direct current from the battery B1 to the light source L1 with a very low forward resistance (which resistance constitutes a loss).

The light source L1 is preferably a 55 watt, 12 v.d.c. quartz halogen bulb. The resistance of the bulb is about 4 ohms. It correspondingly consumes about 55 watts power when energized by a 12 v.d.c. battery B1 power source.

The preferred lithium battery B1 will maintain the light source L1 brightly illuminated for over ten (10) minutes. Other, alternative, battery types including carbon-zinc and nickel-cadmium may also be used dependent upon whether performance or economy is paramount. When the battery B1 have been discharged to a sufficiently low level then the transistor T1 will cease to conduct, and the SCR 1 will turn off. Accordingly, the battery B1 need, and will, not remain electrically connected for an indefinitely prolonged time with such a very low, 4 ohm, resistance across its terminals as can be injurious to some types of rechargeable batteries when they are in a discharged state.

The entirety, any part or parts, or no part of the light grenade 1 may be discarded upon use—dependent upon the preference of the user/owner, the economics of recovery, and the economics of refurbishment/recharge in whole or in part. Normally the entire light grenade 1 is recyclable. It is commonly retrieved after use, including while still producing light illumination. It may be thrown in a trunk or glove box of a vehicle, or in a bag, for transport to a refurbishment/recharge depot, which is commonly a police station or fire house.

A spent light grenade 1 is commonly disassembled by use of a tool, inspected for damage, and reassembled with a fresh battery B1. The spent battery B1 may be recharged in a recharge fixture (not shown) or discarded, as preference and economy dictate. It is possible to build recharging circuitry for the battery B1 internally within the light grenade 1, on the model of certain existing flashlights which are connected directly to wall power in order to be recharged, but this is not preferred due to the added weight and complexity of the recharge circuitry, and its redundancy when large numbers of light grenades 1 are frequently operationally deployed.

A preferred physical construction of the light grenade 1 is shown in FIGS. 3 and 4. The exterior case consists of lower exterior case member C1, typically cylindrical in shape, which is tightly secured to a transparent member D1, typically in the shape of a semi-hemispheric dome, by a semi-permanent attachment mechanism K1, typically a knurled ring. Both the lower exterior case C1 and the knurled ring K1 are typically made from aluminum, normally by machining. They engage each other by a threaded connection, and are typically screwed together so tightly, such as by use of wrenches, that they are not subject to being unscrewed by hand. The dome D1 is preferably hardened, and is typically made from Lexan® plastic (registered trademark of General Electric Company) or Pyrex® glass (registered trademark of Corning Glass Company). It provides 360 degrees circular angle, and nearly four steradians solid angle, of light emission from the contained bulb L1.

The interior of the light grenade 1, best observable in FIG. 4, includes and interior case structural member C2 that positions and supports the battery B1 and the switch S1, and also an interior case member C3 for support of the bulb L1. These interior case members C2, C3 may typically be made of molded plastic, commonly polypropylene plastic.

One electrical connection from the battery B1 to the light source, or bulb, L1 is through the silicon controlled rectifier SCR 1 as selectively enabled by the circuit of discrete components C1, R1, R2, and T1 (all shown in the schematic of FIG. 2). Normally all the discrete components are potted in plastic.

The remaining electrical path from the battery B1 to the light source, or bulb, L1 is through the switch S1. In accordance with the principles of the present invention, this switch is preferably unidirectionally operable by manual use of the hands, and without recourse to hand tools The switch S1 is preferably so unidirectionally operated by a pull tab, or "grenade pin" P1 of simple insulating plastic. The pull tab P1 as initially positioned maintains the spring-loaded contacts of the switch S1 in separation, and the light source L1 off. The pull tab passes from the interior of inner case member C2 and exterior case member C2 trough an aperture within both members. Either of both apertures may be packed with sealant, such as silicon rubber, in order to make the assembled light grenade 1 watertight if so desired.

The pull tab P1 presents a prominent structure to the exterior of case member C1, and the light grenade 1. This structure extends along the exterior of the cylindrical case in the direction of its elongate axis, and even, at its proximal end tip positions, rises a short distance away from the surface of the case member C1. The pull tab P1 is held in position by frangible tape wrap W1, or any other convenient mechanism such as glue for holding a plastic tab.

In actuation of the light grenade 1, the pull tab P1 is grasped with two or more fingers and pulled to separation from the case C1 of the light grenade 1. It may thereafter be discarded. If not discarded, the pull tab P1 is intentionally constructed so as to be barely possible, with some degree of effort and precision, to be reinserted within the apertures of case members C1, C2 and between the contacts of switch S1. Alternatively, the pull tab 1 may be made so flexible, or frangible, so as to be effectively impossible of reinsertion.

The actuation of the light grenade 1 obtained by pulling of the pull tab P1 is normally irreversible save that a special tool (not shown) having the appearance of a miniature flat-blade screwdriver with an insulating plastic blade is pushed trough the apertures of case members C1, C2 and between the contacts of switch S1. The users of the light grenade 1 may have such a supply of disabling tools—which are simple, inexpensive, and themselves disposable—as are desired. Normally, however, it is not considered necessary to disable an energized light grenade, which simply emits light until it is spent.

A supply depot opens the light grenade 1 to gain access to the components therein, including to the battery B1 for recharge or replacement, with simple hand tools on the order of pipe wrenches or strap wrenches. If desired, the exterior case of the light grenade may present detents which wrenches of special form may engage.

The light grenade 1 in accordance with the present invention is intended to be used by policemen and firemen quite readily, and almost casually. It may be placed, thrown, or launched by a projectile-firing device into position of operative use. Particularly as regards launching the light grenade, it may be flung long distances by something as simple as a very large sling shot using elastic bands, or as the head of a arrow-like projectile fired by a bow or crossbow.

The light grenade projectile is approximately the same weight as the large rubber "dum-dums" heavy projectiles that are fired by the R137 firearm made in England by Royal Ordinance and recently, circa 1991, placed in use with the Sheriff's Department of Los Angeles County, Cal., U.S.A. The light projectile will withstand strong "g" forces during launch and landing, and is tailorable to a existing police and firefighting systems.

A public safety officer using the light grenade need not worry that its misdirected or inappropriate deployment will waste much more than one battery charge cycle. The brightly-shining light grenade is unlikely to become lost, or forgotten, once deployed. The fact that it cannot be turned off is seldom troublesome, as it may typically be placed in an officer's pocket or within a vehicle until completely spent, and dark.

On the other hand, the illumination provided by the light grenade, and it manner of so providing this illumination, can, in certain situations, be lifesaving. Criminals or other persons who do not desire to be illuminated by the bright light emitted by the energized light grenade have some difficulty in avoiding or disabling its light output. They must generally expose themselves to illumination while attempting to destroy or to cover a deployed light grenade. Other hostile actions taken, or not taken, toward a deployed light grenade and its light emissions may serve to indicate the state of mind of persons who are illuminated. Each of these events, as well as the basic illumination provided by the light grenade, serve to promote the investigation of darkened areas without undue risk to public safety officers deploying the light grenade, or to occupants of the darkened areas.

In accordance with the preceding explanation, alternative constructions, and modifications, of the light grenade will suggest themselves to a practitioner of the electromechanical design arts. The light grenade could have a case made from many different types of materials. It could realize its preferred unidirectional on actuation by many different types of switches, or else by electrical circuits—such as a flip-flop triggered on one leg only—that may be set so as (i) to enable a light output, but (ii) not to readily be reset.

The light grenade in accordance with the present invention might turn itself on after a variably predetermined interval that might range in duration, for example, to many minutes or hours. The police might thereby "plant" a light grenade in a location of suspicious activity and then lie in wait for the light grenade to go "off".

The light grenade might blink, or produce an output light signal that was encoded in color, frequency, or pattern for purposes of precise identification or communication. The light grenade might turn itself off after a predetermined time interval, thereby to conserve energy, exactly as it now turns itself on after a time interval. The light grenade might be rechargeable through a plugged connection without any necessity of disassembly. The light grenade could employ a chemical, as opposed to and electrical, light source.

According to these and other alterations and adaptations, the present invention should be interpreted broadly, and in accordance with the following claims only, and not solely in accordance with that particular embodiment within which the invention has been taught.

What is claimed is:

1. A portable light source comprising:

a case sufficiently small so as to be grasped and thrown by a human hand and sufficiently rugged so as to remain intact when so thrown;

a source of electrical power within the case;

a light-emitting means located within the case and energizable by the source of electrical power for emitting light;

a manually activated electrical on switch manually unidirectionally activated but one time only, the switch including a first electrical terminal within the case, a second electrical terminal within the case and positionally biased into electrical continuity with the first electrical terminal, and an insulating member extending from between the first and second terminals within the case to a position exterior to the case where it may be manually grasped and withdrawn from the case, and from between the terminals, wherein withdrawal of the insulating members from the case, and from between the terminals, constitutes the unidirectional manual actuation of the switch; and a delay circuit means responsive to a manual actuation of the on switch for connecting the source of electrical power to the light-emitting means only after the lapse of a predetermined interval of time from the manual actuation;

wherein a man may both actuate the manually activated on switch and throw the case within the predetermined interval of time before the light is emitted.

2. The portable light source according to claim 1 wherein the delay circuit means comprises:

a resistor; electrically series connected with a a capacitor responsive to the manually activated on switch for commencing an accumulation of a voltage charge received through the resistor; and a solid state switch responsive to an accumulation of a threshold voltage charge level upon the capacitor for connecting the source of electrical power to the light-emitting means;

wherein a delay in the accumulation of the threshold voltage charge level on the capacitor as received through the resister establishes the predetermined time interval.

3. The portable light source according to claim 1 wherein the case comprises:

a translucent dome for conducting light emitted by the light-emitting means within the case to the exterior of the case.

4. The portable light source according to claim 1 wherein the source of electrical power comprises:

a battery.

5. The portable light source according to claim 1 wherein the light-emitting means comprises:

a light bulb energizable for emitting high-intensity visible light.

6. The portable light source according to claim 1 wherein the light-emitting means comprises:

a light bulb energizable for emitting high-intensity infrared light.

7. A portable light source comprising:

a case sufficiently small so as to be grasped and thrown by a human hand and sufficiently rugged so as to remain intact when so thrown;

a source of electrical power within the case;

a light-emitting means located within the case and energizable by the source of electrical power for emitting light;

a one-way on switch that can manually be activated but which, once activated, is physically incapable of being deactivated; and a delay circuit means responsive to a manual actuation of the on switch for connecting the source of electrical power to the light-emitting means only after the lapse of a predetermined interval of time from the manual actuation;

wherein a man may both actuate the manually activated on switch and throw the case within the predetermined interval of time before the light is emitted.

8. The portable light source according to claim 7 wherein the case comprises:

a translucent dome for conducting light emitted by the light-emitting means within the case to the exterior of the case.

9. The portable light source according to claim 8 wherein the translucent dome consists essentially of high strength glass.

10. The portable light source according to claim 8 wherein the translucent dome consists essentially of high strength glass.

11. The portable light source according to claim 7 wherein the source of electrical power comprises:

a battery.

12. The portable light source according to claim 7 wherein the light-emitting means comprises:

a light bulb energizable for emitting high-intensity visible light.

13. The portable light source according to claim 7 wherein the light bulb comprises:

a quartz halogen light bulb.

14. The portable light source according to claim 7 wherein the light-emitting means comprises:

a light bulb energizable for emitting high-intensity infrared light.

15. The portable light source according to claim 7 wherein the delay circuit means comprises:

a resistor; electrically series connected with a a capacitor responsive to the manually activated on switch for commencing an accumulation of a voltage charge received through the resistor; and a solid state switch responsive to an accumulation of a threshold voltage charge level upon the capacitor for connecting the source of electrical power to the light-emitting means;

wherein a delay in the accumulation of the threshold voltage charge level on the capacitor as received through the resister establishes the predetermined time interval.

16. A portable light source comprising:

an armored case sufficiently small so as to be grasped and thrown by a human hand and sufficiently rugged so as to remain intact when so thrown;

a source of electrical power within the case;

a light-emitting means located within the case and energizable by the source of electrical power for producing light;

a unidirectional electrical switch manually activated but one time to connect the source of electrical power to the light-emitting means, but which switch, having once been so actuated, is thereafter incapable of interrupting this connection;

wherein a man may actuate the switch so as to cause the light to be emitted, and may subsequently throw the case, but neither this nor any other man, having retrieved the thrown case, can thereafter manipulate the switch so as to cause the light emission to cease.

17. The portable light source according to claim 16 further comprising:

a delay circuit means for connecting the source of electrical power to the light-emitting means, therein to produce light, only after the lapse of a predetermined interval of time from a manual actuation of the unidirectional switch;

wherein a man may actuate the switch so as to cause the light to be emitted, and subsequently throw the case, within the predetermined interval of time before the light is produced.

18. A non-injurious agent of coercive intervention usable by law enforcement personnel to manipulate the environment including human actors therein, the agent comprising:

a self-contained self-powered source of visible light that is sufficiently bright so as to be temporarily blinding to the direct view of any human that is close enough to the light source so as to touch it, and for the duration of any interval of so directly viewing the light source;

an armored case for the visible light source which case is sufficiently strong so as to substantially prevent that a human might, by manual force alone and without use of tools, disable the bright light emission of the light source; and an electrical switch that is manually physically manipulatable in but a single manner to the single end of turning on, and which, once so turned on, is incapable of being manually manipulated so as to be turned off;

wherein the light source may be turned on by manual actuation of the turn-on means, and will thereafter emit its bright visible light to the capacity of its self-contained power, but is protected by the case, and also by the unidirectional action of the turn-on means, from being turned off after its initial turn-on.

19. The non-injurious agent of coercive intervention according to claim 18 wherein the manually physically unidirectional activated electrical switch is capable of being manipulated so as to be turned off by use of a tool.

* * * * *